US006658742B2

(12) United States Patent
Votolato

(10) Patent No.: US 6,658,742 B2
(45) Date of Patent: Dec. 9, 2003

(54) BAG SLITTING APPARATUS WITH FLAT CUTTING BLADE

(76) Inventor: Earl J. Votolato, PMB 400, 3419 Via Lido, Newport Beach, CA (US) 92663

( * ) Notice: Subject to any disclaimer, the term of this patent is extended or adjusted under 35 U.S.C. 154(b) by 0 days.

(21) Appl. No.: 09/753,839

(22) Filed: Jan. 3, 2001

(65) Prior Publication Data

US 2002/0000045 A1 Jan. 3, 2002

Related U.S. Application Data

(63) Continuation-in-part of application No. 09/607,477, filed on Jun. 30, 2000.

(51) Int. Cl.[7] ..... B26B 3/00

(52) U.S. Cl. ..... 30/280; 30/278; 30/DIG. 3; D8/102

(58) Field of Search ..... D7/669; D8/98, D8/102; 30/2, 278, 280, 294, DIG. 3, 289, 1.5

(56) References Cited

U.S. PATENT DOCUMENTS

| | | | | | |
|---|---|---|---|---|---|
| 1,082,400 | A | * | 12/1913 | Burnite | 30/289 |
| 1,216,899 | A | * | 2/1917 | Todd | 30/289 |
| 3,142,426 | A | * | 7/1964 | Busse | 83/649 |
| 3,727,272 | A | * | 4/1973 | Rhodes | 24/300 |
| D235,306 | S | * | 6/1975 | Christian et al. | 30/355 |
| D276,786 | S | | 12/1984 | Chen | D8/41 |
| 4,581,823 | A | * | 4/1986 | Gilman | 30/280 |
| 4,711,031 | A | * | 12/1987 | Annello | 30/2 |
| D298,210 | S | | 10/1988 | Hutson et al. | |
| 4,887,355 | A | | 12/1989 | Colbert | |
| 5,007,171 | A | | 4/1991 | Horning, Jr. | 30/294 |
| D419,417 | S | * | 1/2000 | Kane | D8/98 |

FOREIGN PATENT DOCUMENTS

| | | | | |
|---|---|---|---|---|
| GB | 2234699 | * | 2/1991 | 30/2 |

* cited by examiner

*Primary Examiner*—Allan N. Shoap
*Assistant Examiner*—Thomas J Druan, Jr.
(74) *Attorney, Agent, or Firm*—Rutan & Tucker; Robert D. Fish

(57) ABSTRACT

A bag slitting apparatus for opening a sealed bag along an edge of the bag. The apparatus has a first arm having first outer and inner surfaces, and a second arm having second outer and inner surfaces. The arms are in tensioned movable opposed relationship to each other such that the first and second inner surfaces are movably positionable against each other. One of these inner surfaces is a bladed inner surface having extending inwardly therefrom a non-pointed, generally flat, bag cutting blade, while the other inner surface has extending inwardly therefrom a cutting surface. Exteriorly, the first and second outer surfaces are concavely contoured for simultaneous opposingly-squeezing receipt of a finger and thumb of a user for slitting the edge of the bag between the blade and cutting surface.

6 Claims, 1 Drawing Sheet

BAG SLITTING APPARATUS WITH FLAT CUTTING BLADE

CROSS-REFERENCE TO RELATED APPLICATIONS

This application is a continuation-in-part of co-pending U.S. patent application U.S. patent application Ser. No. 09/607,477, filed Jun. 30, 2000.

BACKGROUND OF THE INVENTION

The present invention relates in general to bag slitting apparatus for opening a sealed bag, and in particular to a bag slitting apparatus for opening a sealed bag along an edge thereof and generally constructed as a spring-tensioned, opposing arm device wherein the inner surface of one arm thereof has a substantially flat blade for slitting a bag placed between the arms and wherein the outer surfaces of the arms are concavely contoured for simultaneous opposing receipt of a finger and thumb of a user.

Employment of sealed, usually transparent, plastic bags for housing various products is a well-accepted packaging approach for maintaining such commodities in a ready-to-use condition. Typical products include those produced in food, medical, pharmaceutical, and chemical industries where clean individual-item packaging is generally required. While such sealed bags are highly efficient in maintaining product integrity, access into the interior of a bag for retrieval of a packaged product therein housed many times is not convenient. In particular, a user may need to hand-tear a hole into the bag, or juggle the bag and its housed product while attempting to awkwardly use a cumbersome scissors, utility knife, razor blade, or the like to cut an opening through the bag wall. Not only are such approaches possibly hazardous to the user, they also can be damaging to the product housed in the bag.

In view of the above described obstacles, it is apparent that a need is present for an easily and conveniently usable bag opener. Accordingly, a primary object of the present invention is to provide a conveniently operable bag slitting apparatus for opening a sealed bag along an edge thereof.

Another object of the present invention is to provide a bag slitting apparatus wherein opposing tensioned arm members cooperatively embrace the bag and present a non-pointed, generally flat blade there between for slitting the bag during linear apparatus movement.

Yet another object of the present invention is to provide a bag slitting apparatus wherein the opposing tensioned arm members have outer surface portions that are concavely contoured for simultaneous opposing receipt of a finger and thumb of a user.

These and other objects of the present invention will become apparent throughout the description thereof which now follows.

BRIEF SUMMARY OF THE INVENTION

The present invention is a bag slitting apparatus for opening a sealed bag along an edge of the bag. The apparatus has a first arm having a first outer surface and a first inner surface, and a second arm having a second outer surface and a second inner surface. The first and second arms are in tensioned movable opposed relationship to each other such that the first and second inner surfaces are movably positionable against each other. One of these inner surfaces is a bladed inner surface having extending inwardly therefrom a non-pointed, generally flat, bag cutting blade, while the other inner surface has extending inwardly therefrom a cutting surface. Exteriorly, the first and second outer surfaces are concavely contoured for simultaneous opposingly-squeezing receipt of a finger and thumb of a user.

The apparatus is meant to be disposable once the blade becomes dull to thereby eliminate inadvertent mishaps such as those which can occur with a conventional utility knife while changing a blade. Depending upon use-environment, the apparatus can be fabricated of autoclavable material to thereby maintain clean-room conditions. Additionally, apparatus construction preferably provides smooth transitions of all surface structures to thereby inhibit contamination and resulting potential cross-contamination during subsequent use. As is apparent, the bag slitting apparatus here defined provides operational utility while supporting convenience, efficiency, and safety in retrieving packaged products.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENT

Figure 1:
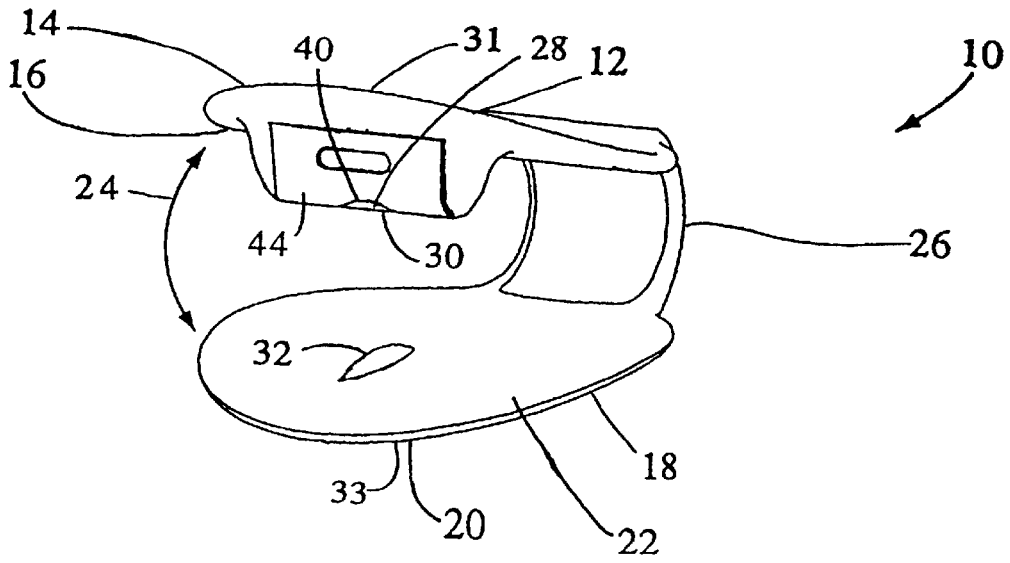
FIG. 1 is a perspective view of a bag slitting apparatus for opening a sealed bag.
Figure 2:
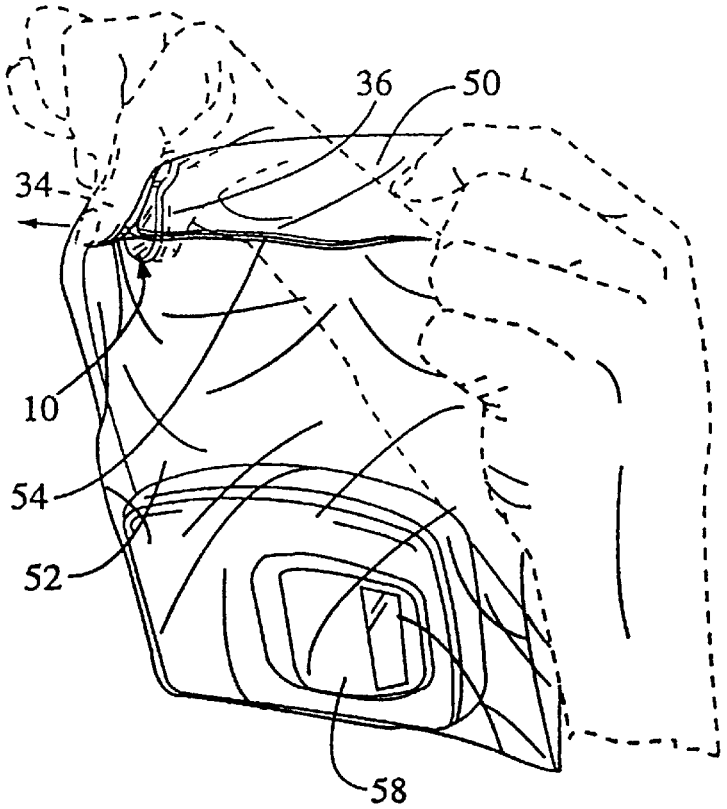
FIG. 2 is a perspective view showing operation of the apparatus of FIG. 1.

Referring to FIGS. 1 and 2, a bag slitting apparatus 10 for opening a sealed bag along an edge thereof is shown. The apparatus 10 has a first arm 12 having a first outer surface 14 and a first inner surface 16, and a second arm 18 having a second outer surface 20 and a second inner surface 22. The first and second arms 12, 18 are in tensioned movable opposed relationship to each other such that the first and second inner surfaces 16, 22 are movably positionable against each other as indicated by the arrow 24 of FIG. 1. Such tensioned relationship is conventionally attained by kinetically stressing the bridge 26 joining the arms 12, 18, as known in the art. One of the inner surfaces, here shown as the first inner surface 16, is a bladed inner surface having extending therefrom a bag cutting blade 28 with a flat edge 30, while the other inner surface, here shown as the second inner surface 22, has an inwardly extending cutting surface here non-limitedly configured as a convex bubble surface 32 in alignment with the blade edge 30. The apparatus 10, including the blade 28, can be fabricated as a single piece of plastic. Alternatively, the apparatus 10 can be a two-piece construction of a separate blade and a single piece of plastic for the remainder of the apparatus, or a three-piece construction of a separate blade, a blade retainer cap 44, and a single piece of plastic for the remainder of the apparatus. With all such constructions, only a central portion 40 of the cutting edge 30 is exposed for safety concerns. The first and second outer surfaces 14, 20 are concavely contoured distally for simultaneous opposing receipt of a finger 34 and thumb 36 of a user as shown in FIG. 2.

Operation of the apparatus 10 is shown in FIG. 2. As is there shown, the concavely contoured portions 31, 33 of the first and second outer surfaces 14, 20 are grasped by a finger 34 and thumb 36 of a user, and an edge portion 50 of a plastic bag 52 is positioned between the blade edge 30 and convex bubble surface 32. The first and second arms 12, 18 are squeezed toward each other and the exposed portion of the blade edge 30 cuts the bag 52 as inward movement terminates on the bubble surface 32. Once such engagement is accomplished, the apparatus 10 is moved along the length of the edge portion 50 of the bag 52 to thereby produce a slit 54 through the bag 52. The apparatus 10 is then withdrawn by releasing finger pressure thereon, and the user can reach through the slit 54 into the bag 52 and retrieve a product 58 therein packaged. In this manner, the bag 52 is efficiently and safely opened, and the apparatus 10 is immediately ready for re-use in opening subsequent bags as needed. While a plastic bag 52 is here illustrated, it is to be understood that the apparatus 10 can be employed in opening bags as well as envelopes fabricated of paper, synthetic polymer products and the like.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A bag slitting apparatus, comprising:

a first arm carrying a blade that is protected by a covering on each end, such that only a central cutting surface of the blade is exposed; and a second arm opposable to the first arm, and having a convexity that cooperates with the exposed cutting surface to make a cut through a portion of the bag when the first and second arms are opposed about the bag, and wherein the covering on each end of the blade extends farther in a direction facing the second arm than the exposed cutting surface.

2. The bag slitting apparatus of claim 1, wherein the first and second arms have a continuous smooth contour with no inside corners.

3. The bag slitting apparatus of claim 1, wherein the two arms comprise a continuous single piece of material.

4. The apparatus of claim 3 wherein the first arm, the second arm, and the convexity are comprised substantially of plastic.

5. The apparatus of claim 1, wherein the first arm and second arms are concavely contoured to receive a user's finger and thumb, respectively.

6. The apparatus of claim 1, wherein the blade is metal.

* * * * *